US007370442B2

(12) United States Patent
Jung et al.

(10) Patent No.: US 7,370,442 B2
(45) Date of Patent: May 13, 2008

(54) ANKLE SUPPORT TO BE ATTACHED TO FOOTWEAR AND FOOTWEAR EQUIPPED WITH IT

(75) Inventors: Young Kyun Jung, Seoul (KR); Young Il Joen, Namyangju-si (KR)

(73) Assignee: Cerbio Co., Ltd., Chungcheongnam-do (KR)

( * ) Notice: Subject to any disclaimer, the term of this patent is extended or adjusted under 35 U.S.C. 154(b) by 0 days.

(21) Appl. No.: 11/357,669

(22) Filed: Feb. 17, 2006

(65) Prior Publication Data

US 2006/0137226 A1 Jun. 29, 2006

Related U.S. Application Data

(63) Continuation of application No. PCT/KR2005/000741, filed on Mar. 15, 2004.

(30) Foreign Application Priority Data

Mar. 15, 2004 (KR) ..... 2004-17285
Sep. 24, 2004 (KR) ..... 2004-76944

(51) Int. Cl.
*A43B 7/20* (2006.01)

(52) U.S. Cl. ..... 36/89; 36/88

(58) Field of Classification Search ..... 36/88, 36/89, 90, 51, 54

See application file for complete search history.

(56) References Cited

U.S. PATENT DOCUMENTS 312,675 A * 2/1885 Turner ..... 36/51
757,816 A * 4/1904 Krieger ..... 36/89
950,333 A * 2/1910 Koch ..... 36/3 A
975,820 A * 11/1910 Azzara ..... 36/89
1,028,598 A * 6/1912 Papp ..... 36/54
1,210,255 A * 12/1916 Altschul ..... 36/89
1,441,677 A * 1/1923 Golden ..... 36/89
1,586,698 A * 6/1926 Posner ..... 36/89

(Continued)

FOREIGN PATENT DOCUMENTS

EP 346244 A1 * 12/1989

(Continued)

OTHER PUBLICATIONS

International Search Report PCT/KR20-05/000741, Jul. 12, 2005.

*Primary Examiner*—Marie Patterson
(74) *Attorney, Agent, or Firm*—Graybeal, Jackson, Haley, LLP

(57) ABSTRACT

Disclosed herein is footwear having an ankle support. The footwear has a sole, an upper, and a heel section. The ankle support is worn to surround part of the foot and part of the leg between which an ankle joint is located, wherein a lower portion of the ankle support is secured to an interior of the footwear. According to this invention, the wearer's ankle joint moves together with the ankle support without being constrained by the footwear, thus ensuring the flexible movement of the ankle, therefore allowing unrestricted motion. Further, the lower portion of the ankle support is attached to the interior of the footwear, thus allowing the wearer's ankle to be supported by both the footwear and the ankle support, therefore efficiently supporting the ankle, even when large shocks are applied to the ankle due to intense activity.

11 Claims, 8 Drawing Sheets

U.S. PATENT DOCUMENTS

| | | | | | |
|---|---|---|---|---|---|
| 2,444,428 | A | * | 7/1948 | Carrier | 36/99 |
| 2,531,763 | A | * | 11/1950 | Andre | 36/117.8 |
| 2,994,136 | A | * | 8/1961 | Reinhart et al. | 36/90 |
| 3,970,083 | A | * | 7/1976 | Carrigan | 602/65 |
| 4,366,634 | A | | 1/1983 | Giese et al. | |
| 4,411,077 | A | * | 10/1983 | Slavitt | 36/89 |
| 4,621,648 | A | * | 11/1986 | Ivany | 602/27 |
| 4,864,741 | A | * | 9/1989 | Beauchemin | 36/89 |
| 4,922,630 | A | * | 5/1990 | Robinson | 36/89 |
| 5,007,417 | A | * | 4/1991 | Bender | 602/27 |
| 5,056,509 | A | * | 10/1991 | Swearington | 602/29 |
| 5,090,138 | A | * | 2/1992 | Borden | 36/102 |
| 5,365,677 | A | * | 11/1994 | Dalhgren | 36/3 A |
| 5,416,987 | A | * | 5/1995 | Bemis et al. | 36/50.1 |
| 5,430,960 | A | | 7/1995 | Richardson | |
| 5,498,033 | A | * | 3/1996 | Hoshizaki et al. | 280/841 |
| 5,672,156 | A | * | 9/1997 | Jimenez Ramos | 602/27 |
| 5,865,778 | A | * | 2/1999 | Johnson | 602/27 |
| 5,943,793 | A | | 8/1999 | Clements | |
| 5,946,827 | A | * | 9/1999 | Okajima | 36/58.5 |
| 6,032,286 | A | * | 3/2000 | Thomas et al. | 2/22 |
| 6,053,884 | A | * | 4/2000 | Peters | 602/27 |
| 6,102,881 | A | * | 8/2000 | Quackenbush et al. | 602/28 |
| 6,524,266 | B1 | * | 2/2003 | Peters | 602/27 |
| 6,749,578 | B2 | * | 6/2004 | Peters | 602/27 |
| 6,858,017 | B2 | * | 2/2005 | Peters | 602/27 |
| 7,171,766 | B2 | * | 2/2007 | Bouche et al. | 36/89 |
| 2002/0062579 | A1 | * | 5/2002 | Caeran | 36/115 |
| 2005/0198869 | A1 | * | 9/2005 | Bouche et al. | 36/89 |

FOREIGN PATENT DOCUMENTS

| | | | | |
|---|---|---|---|---|
| EP | 486801 | A1 | * | 5/1992 |
| JP | 57-34804 | U | | 2/1982 |
| JP | 3107328 | B2 | | 11/1993 |
| JP | 8-24601 | B2 | | 11/1994 |
| KR | 1983-2577 | Y1 | | 12/1983 |
| KR | 89-5433 | | | 11/1990 |
| KR | 0223578 | Y1 | | 6/2001 |
| KR | 2003-0016830 | | | 8/2003 |
| WO | WO 9404049 | A1 | * | 3/1994 |

* cited by examiner

ANKLE SUPPORT TO BE ATTACHED TO FOOTWEAR AND FOOTWEAR EQUIPPED WITH IT

CROSS-REFERENCE TO RELATED APPLICATION

This is a continuation application that claims benefit, under 35 USC § 120, of co-pending International Application PCT/KR2005/000741, filed 15 Mar. 2005, designating the United States, which claims foreign priority benefits under 35 USC § 119(*a*) to Korean Patent Application Nos. 2004-17285 filed 15 Mar. 2004 and 2004-76944 filed 24 Sep. 2004 which are incorporated herein by reference.

TECHNICAL FIELD

The present invention relates, in general, to an ankle support attached to footwear and, more particularly, to an ankle support which is attached to a sole in the interior of footwear and is worn to surround a leg portion above the ankle joint. Further, the present invention relates to footwear having such an ankle support.

BACKGROUND ART

Generally, footwear has a sole, an upper, and a heel section. The footwear is typically classified into a shoe whose heel section does not extend above the ankle joint, and a boot whose heel section extends higher than the ankle joint.

Boots are suitable for a wearer who must work in relatively inhospitable surroundings. Boots include work footwear, safety footwear, military footwear, etc. In this case, the work footwear or the safety footwear need only prevent foreign objects from contacting a wearer's leg or entering the interior of the footwear. Thus, the work footwear or the safety footwear is worn to loosely surround the wearer's leg. On the other hand, the military footwear or the like must prevent a wearer from being injured, for example, to prevent the wearer's ankle from being sprained, due to excessive twisting, rotation, or bending of a leg portion and a foot portion between which the ankle joint is positioned, when the wearer is active with the footwear on. Thus, the military footwear or the like is worn to be in close contact with the wearer's leg.

The boot has many advantages, that is, it prevents foreign objects from entering the interior of the boot, in addition to preventing a wearer from being injured. However, the boot has a drawback in that it hinders the natural motion of the wearer's foot or ankle joint.

Therefore, for general footwear or athletic footwear, the shoe is preferable to the boot.

The shoe allows a wearer to move quickly. However, the shoe has no means to prevent the foot or the ankle joint from being excessively twisted, rotated, or bent.

Hence, the boot is preferred as athletic footwear for activities that do not require much natural motion of the ankle joint, especially riding boots. Meanwhile, in cases where it is required to allow active motion and prevent injuries to the ankle joint, like basketball shoes, a compromise between the shoe and the boot, namely, semi-boots are utilized.

However, shoes must be inevitably used as athletic footwear for sports requiring much activity, such as soccer shoes or baseball shoes. Thus, the wearer is always exposed to the danger of injury.

Taking activity into consideration, attempts have been made to develop semi-boot-style athletic footwear. For example, Korean U.M. Appln. No. 1998-5838 and Korean U.M. Appln. No. 2003-16830 have been proposed. The U.M. Appln. No. 1998-5838 was filed by the inventor of this invention, and is titled "ATHLETIC FOOTWEAR HAVING IMPROVED SAFETY AND LIFE SPAN". Further, the U.M. Appln. No. 2003-16830 was filed by the inventor of this invention, and is titled "ATHLETIC FOOTWEAR HAVING ANKLE PROTECTOR".

In addition, the semi-boot-style athletic footwear has been proposed in Japanese U.M. Laid-Open Publication No. Sho57-34804 which is titled "ATHLETIC FOOTWEAR", U.S. Pat. No. 5,430,960 which is titled "LIGHTWEIGHT ATHLETIC SHOE WITH FOOT AND ANKLE SUPPORT SYSTEMS", and U.S. Pat. No. 5,943,793 which is titled "SHOE OR BOOT WITH ADJUSTABLE ANKLE COLLAR".

The above-mentioned semi-boot-style athletic footwear includes an ankle protecting part, which extends from an upper end of a heel section to a leg portion above the wearer's ankle joint, and is worn to surround the leg portion above the ankle joint.

Although the conventional semi-boot-style athletic footwear is provided with various means to afford unrestricted motion to a wearer, the semi-boot-style athletic footwear other than basketball shoes does not appeal to consumers.

In order to reduce the danger of injury, an ankle protector of FIG. 1 has come onto the market. Many athletes frequently put on footwear with such an ankle protector on.

However, the ankle protector 100 merely surrounds a leg portion extending from the heel of the foot to a portion above the ankle joint. That is, the ankle protector 100 is separate from the footwear, so that the ankle protector 100 may move relative to the footwear without constraint.

Therefore, although a person wears the ankle protector 100, the wearer's ankle joint may be excessively twisted, rotated, or bent, due to force exerted on the footwear.

Further, Korean U.M. Appln. No. 1989-5433 discloses an ankle protector, which is attached to footwear and worn, and is titled "ATHLETIC FOOTWEAR WITH DETACHABLE ANKLE PROTECTOR".

The conventional ankle protector is configured such that it is fastened to an upper end of a heel section of a shoe using a zipper. When the ankle protector is fastened to the shoe, the shoe assumes the shape of the conventional semi-boot-style athletic footwear.

DISCLOSURE

Technical Problem

Accordingly, the present invention has been made keeping in mind the above problems occurring in the prior art, and an object of the present invention is to provide an ankle support, which is attached to a sole in the interior of footwear and is worn to surround a leg portion above the wearer's ankle joint.

Another object of the present invention is to provide footwear having the ankle support which is attached to the sole in the interior of the footwear.

A further object of the present invention is to provide footwear having an interaction means which engages or cooperates with an attaching means that is provided on a lower end of the ankle support so as to attach the ankle support to the sole in the interior of the footwear.

Technical Solution

According to this invention, an ankle support is attached to a sole. However, it is unnecessary to attach the ankle support directly to the sole. That is, all or part of the ankle support may be attached to a heel section or an upper which is coupled to the sole. Such attachment does not limit the spirit and scope of this invention. Therefore, it is to be understood that the expression used in the preferred embodiment as well as in the claims, "the ankle support is attached to the sole", includes both direct attachment and indirect attachment.

In the case of indirect attachment, it is preferable that the ankle support be attached as close to the sole as possible. However, in the case in which the ankle support is attached to a position distant from the sole, this must be considered as one embodiment of this invention.

In order to accomplish the above objects, the present invention provides an ankle support secured to an interior of footwear and worn to surround part of a foot and part of a leg between which an ankle joint is located.

The ankle support includes an attaching means provided on a lower end of the ankle support and attaching the ankle support to the interior of the footwear, a leg covering means constructed such that at least part of the ankle support surrounds a leg portion above the wearer's ankle joint, and a support means provided between the leg covering means and the attaching means, the support means preventing the wearer's foot from moving about the ankle joint beyond a predetermined range.

The support means may include at least one reinforcing strip. The reinforcing strip comprises a first strip part arranged along a wearer's Achilles' tendon to couple the leg covering means to the attaching means, a second strip part located over a wearer's inside malleolus to couple the leg covering means to the attaching means, and a third strip part located over a wearer's outside malleolus to couple the leg covering means to the attaching means.

The leg covering means may include a strip which is coupled to an upper end of the support means to surround the leg portion above the wearer's ankle joint.

Further, footwear of this invention includes an ankle support which is attached to a sole in the interior of the footwear, and is worn to surround part of the foot and part of the leg between which the ankle joint is positioned.

A leg covering means of the ankle support is constructed such that at least part of the ankle support surrounds a leg portion above the wearer's ankle joint.

A support means, extending from the lower portion of the ankle support secured to the footwear to the leg covering means, prevents the wearer's foot from moving about the ankle joint beyond a predetermined range.

The support means may include at least one reinforcing strip. The reinforcing strip may comprise a first strip part arranged along a wearer's Achilles' tendon and extending from the lower portion secured to the footwear to the leg covering means, a second strip part located over a wearer's inside malleolus to extend to the leg covering means, and a third strip part located over a wearer's outside malleolus to extend to the leg covering means.

An aerating part may be provided between the first, second and third strip parts to allow air to flow in and out of the footwear.

The leg covering means may include a strip which is coupled to an upper end of the support means to surround the leg portion above the wearer's ankle joint.

The upper includes a toe top to cover wearer's toes, a first vamp to cover an inside portion of a top side of the foot, a second vamp to cover an outside portion of the top side of the foot, and a tongue coupled at an end thereof to the toe top, and covering the top side of the foot.

At least part of the ankle support may be secured to the heel section, the first vamp, or the second vamp of the footwear.

The tongue includes a heat dissipation part, the heat dissipation part extending upwards from a position where a wearer's ankle bends, and dissipating heat from the interior of the footwear. The tongue includes a pair of extension parts, the extension parts extending outwards from both sides of the heat dissipation part and being secured to the interior of the footwear.

At least part of each of the extension parts comprises an elastic band having elasticity. Each of the extension parts is secured to the interior of the footwear while being positioned between an inside surface of the footwear and an outside surface of the ankle support.

The footwear may further include a vamp tightening unit to pull a side end of the first vamp and a side end of the second vamp, thus allowing the side ends of the first and second vamps to approach each other.

The leg covering means of the ankle support is cut at a position ranging from the top side of the foot to a shinbone, and a tightening unit is provided at the cut position to pull both ends of the leg covering means, thus causing the ends of the leg covering means to approach each other.

A first end of the cut leg covering means is continuously connected to the side end of the first vamp, and a second end of the cut leg covering means is continuously connected to the side end of the second vamp.

In order to accomplish the above objects, the present invention provides a footwear having a sole, an upper, and a heel section, wherein an attaching means for attaching an ankle support to the footwear is positioned in the footwear, the ankle support being worn to surround part of a foot and part of a leg between which the ankle joint is positioned.

Advantageous Effects

According to the present invention, the wearer's ankle joint moves together with an ankle support without being constrained by footwear, thus ensuring the flexible movement of the ankle, therefore allowing unrestricted motion. Further, according to this invention, a lower portion of the ankle support is attached to an interior of the footwear, thus allowing the wearer's ankle to be supported by both the footwear and the ankle support, therefore efficiently supporting the ankle, even when large forces are applied to the ankle due to intense activity.

Particularly, when this invention is adapted to athletic footwear, the ankle support of this invention prevents the wearer's ankle from being bent due to external forces or wearer's carelessness, thus efficiently protecting the ankle joint joining the ankle to the foot and various ligaments, such as the Achilles' tendon, in addition to allowing the wearer's ankle to freely move. Therefore, the wearer can enjoy desired sports without worrying about injuring the ankle.

BEST MODE

Hereinafter, an ankle support and footwear with the ankle support, according to the preferred embodiment of this invention, will be described with reference to the accompanying drawings.

Figure 1:
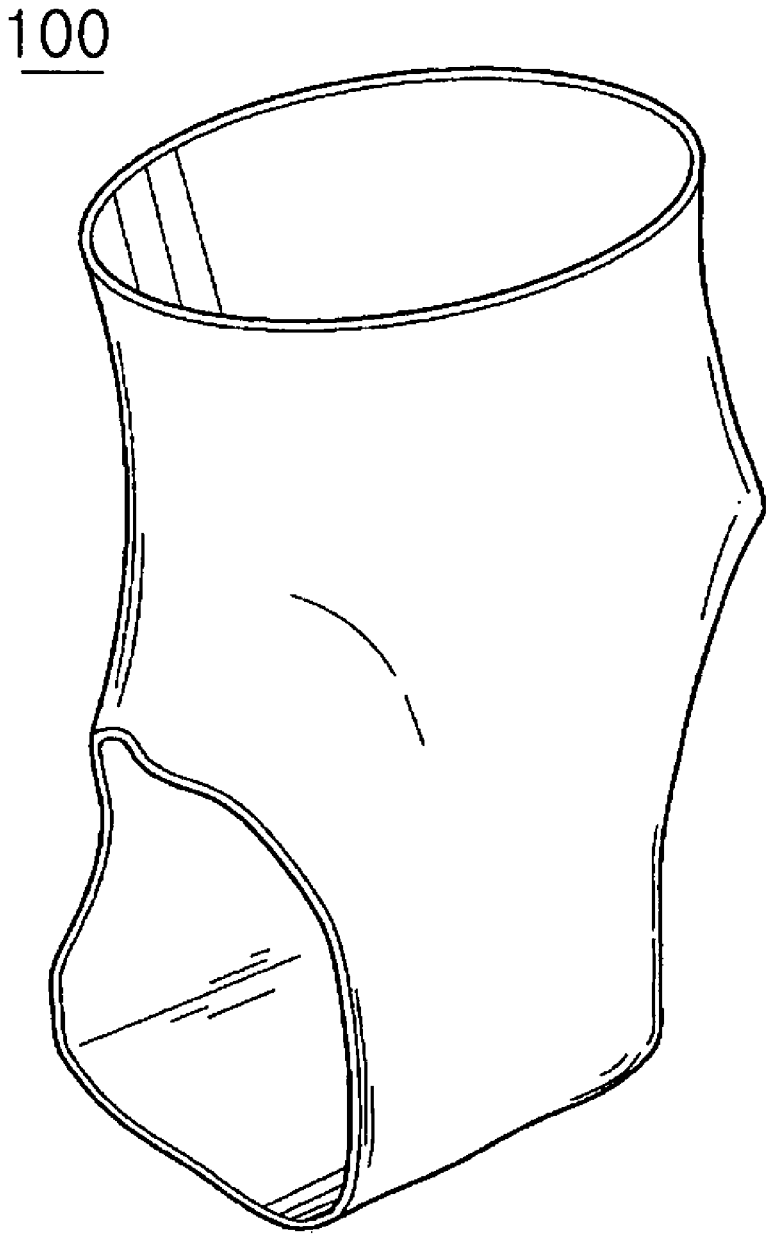
FIG. 1 (Prior Art)
FIG. 1 is a perspective view of a conventional ankle protector.
Figure 2:
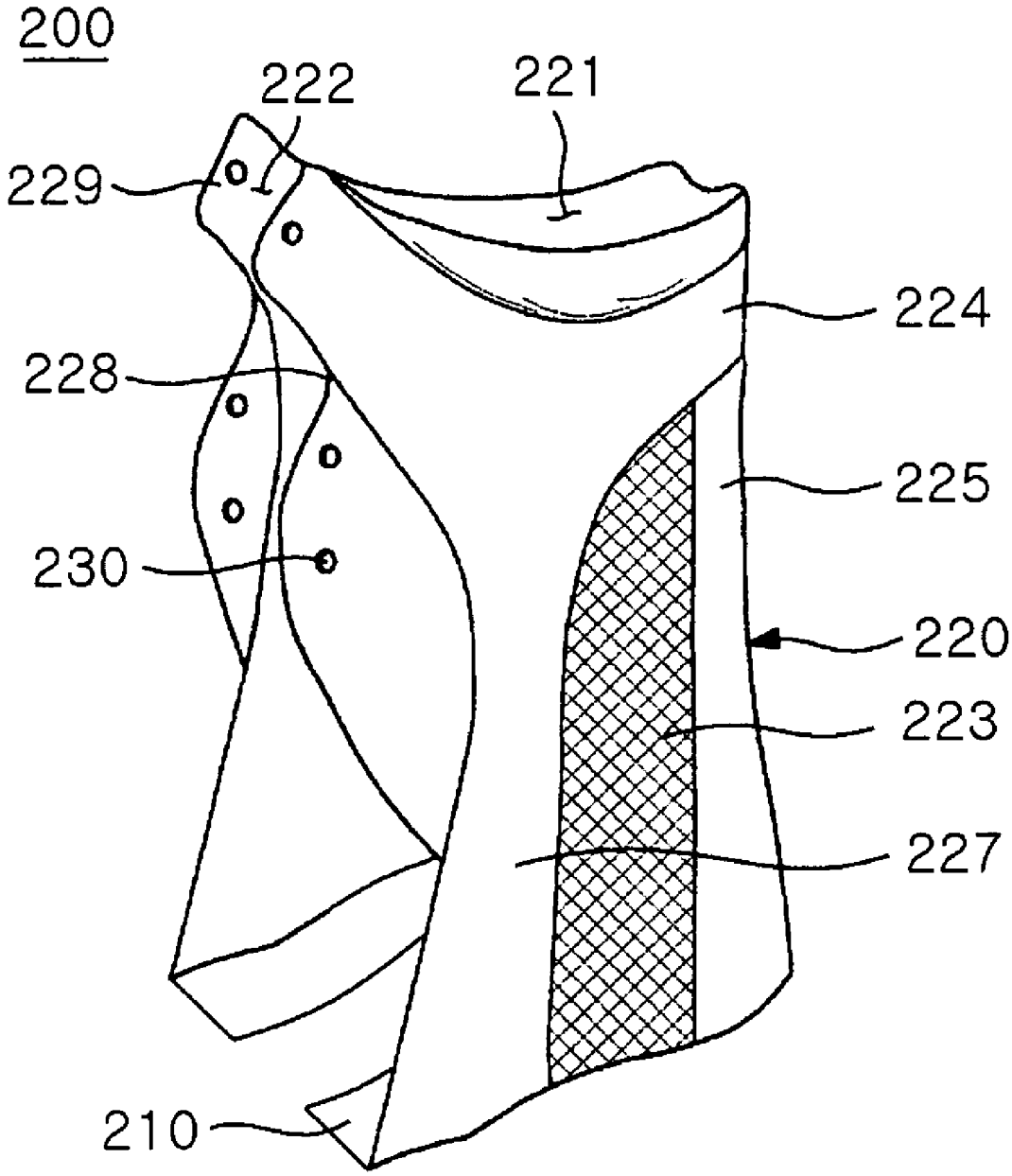
FIG. 2 is a perspective view of an ankle support to be attached to footwear, according to an embodiment of the present invention.
Figure 3:
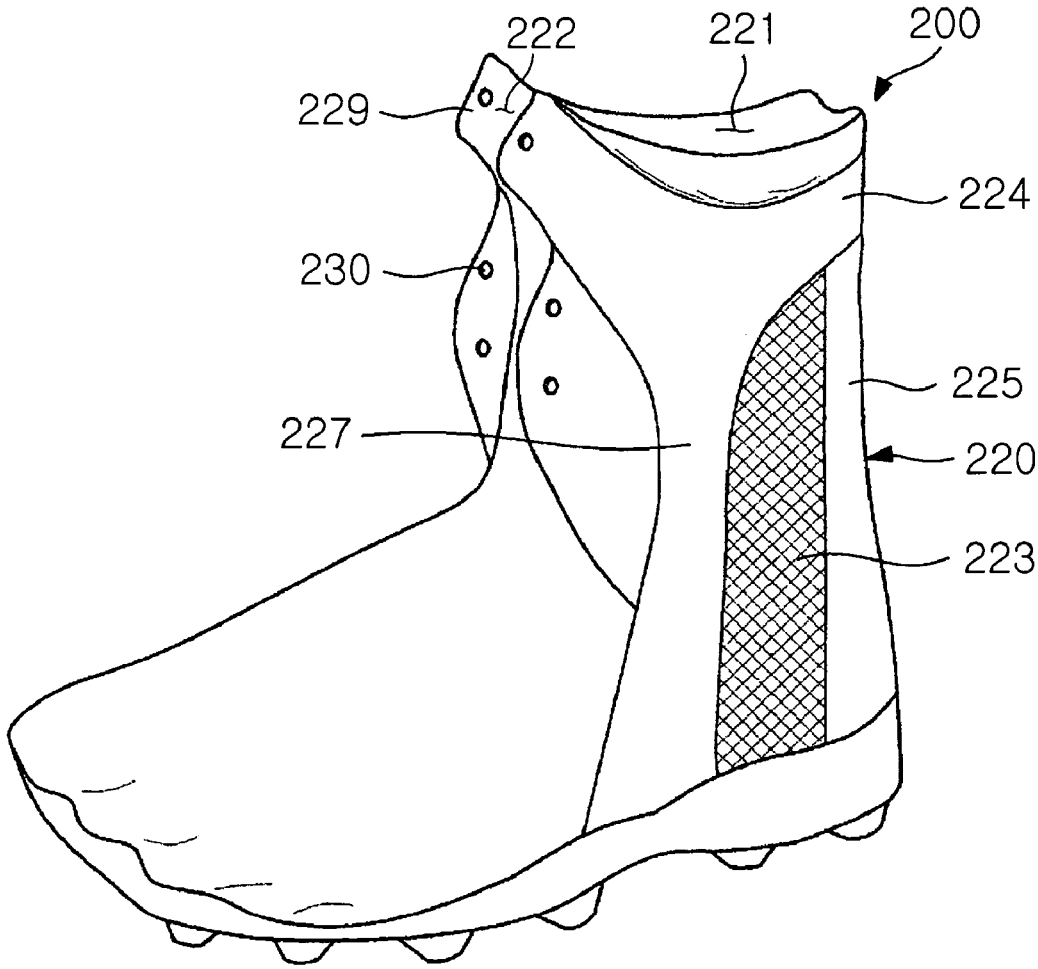
FIG. 3 is a perspective view to schematically show the state where a wearer's foot is fitted into the ankle support of FIG. 2.
Figure 4:
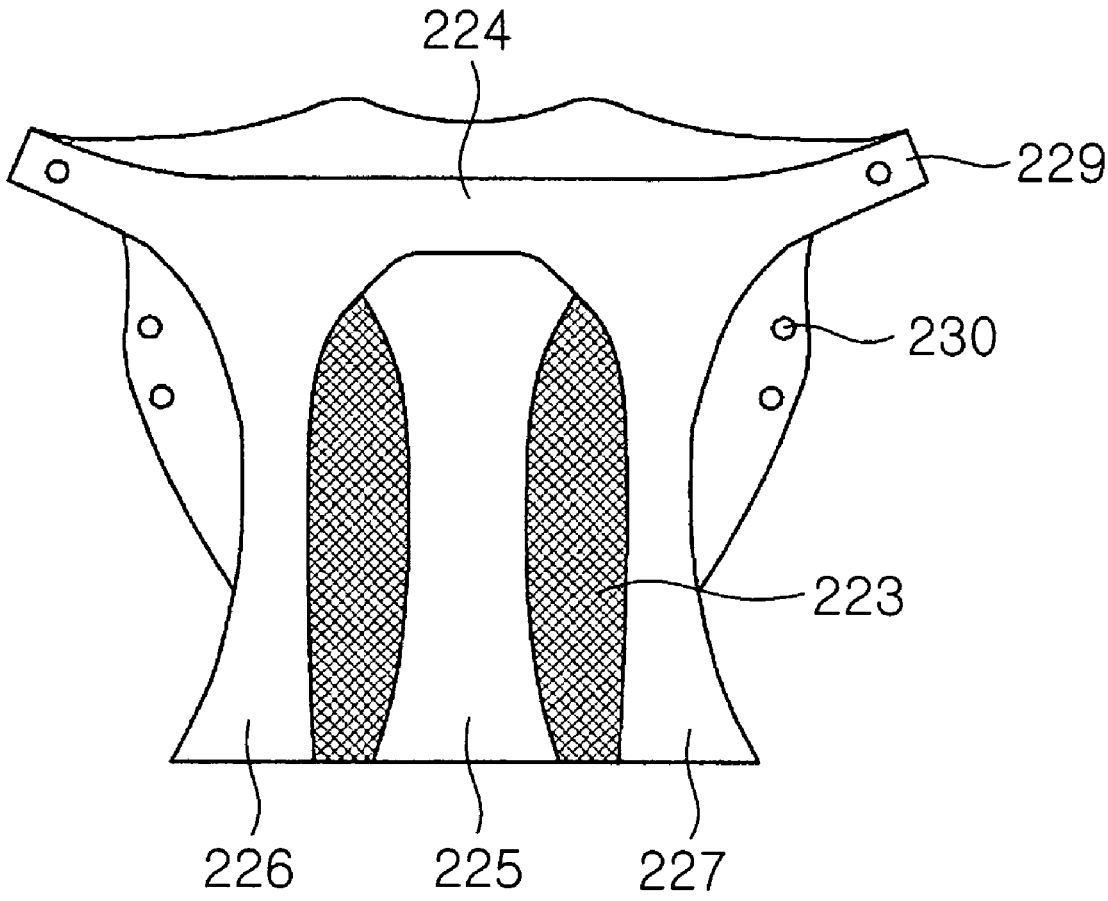
FIG. 4 is a development figure of the ankle support of FIG. 3.

FIG. 2 is a perspective view of an ankle support to be attached to footwear, according to an embodiment of the present invention, FIG. 3 is a perspective view to schematically show the state where a wearer's foot is fitted into the ankle support of FIG. 2, and FIG. 4 is a development figure of the ankle support of FIG. 3.

As shown in FIGS. 2 to 4, an ankle support 200 of this invention is configured so that the ankle support 200 is attached to a sole in the interior of a general shoe not extending above the ankle, and extends upwards from a heel section of the footwear to surround a leg portion above the ankle joint. That is, the ankle support 200 is attached to the sole (e.g. an upper surface of a midsole) in the interior of the footwear. Thus, an attaching means 210 is provided on a lower portion of the ankle support 200 to attach the ankle support 200 to the sole in the interior of the footwear. The attaching means 210 may have any shape, as long as the attaching means 210 attaches the ankle support 200 to the sole. It is preferable to further include an additional attaching member, such as a Velcro fastener. In this case, part of the attaching means 210 may be opened. Alternatively, the attaching means 210 may be completely closed. FIG. 2 shows the attaching means 210 which is partly opened.

Further, the ankle support 200 is provided with an ankle support part 220. The attaching means 210 is attached to the sole in the interior of the footwear, while the ankle support part 220 extends upwards from the heel section to surround part of the foot and part of the leg between which the wearer's ankle joint is positioned, thus supporting the ankle. The ankle support part 220 includes a leg covering means and a support means. In this case, the leg covering means is configured to surround a leg portion above the wearer's ankle joint. The support means is provided between the leg covering means and the attaching means 210, thus preventing the wearer's foot from moving about the ankle joint beyond a predetermined range.

A foot insertion hole 221 is formed on an upper end of the ankle support part 220 to allow the wearer's foot to be inserted into the ankle support part 220. Further, an opening 222 is provided at a predetermined position on the ankle support part 220 such that the wearer's foot may be conveniently inserted into the ankle support part 220. In this case, the ankle support part 220 may be made of one kind of material to have a single structure. Alternatively, the ankle support part 220 may be made of different kinds of materials. In this case, different parts are sewn to each other to provide the ankle support part 220.

The ankle support part 220 also includes a tightening unit which closes the opening 222 provided at a predetermined position on the ankle support part 220, thus allowing the ankle support 200 to be in close contact with the wearer's ankle. The tightening unit may comprise a plurality of eyelets that are formed on both sides of the ankle support part 220 and a general shoelace lacing the footwear. Further, the tightening unit may comprise a Velcro fastener which is provided on both sides of the ankle support part 220. Furthermore, the tightening unit may comprise a slide fastener which is sewn along both side ends of the ankle support part 220. In addition, the tightening unit may comprise a belt which has a buckle and a punch hole on respective sides of the ankle support part 220. The tightening unit may comprise a combination of the above-mentioned elements.

When the ankle support 200 of this invention is adapted to general footwear, the ankle support part 220 is preferably configured to prevent foreign objects from entering the interior of the footwear through the opening 222. Thus, it is preferable that the ankle support part 220 further include a tongue (not shown). The tongue is secured at an end thereof to an inside surface of the ankle support part 220, and is large enough to cover the opening 222. Preferably, the tongue of the ankle support part 220 is made such that the lower part of the tongue overlaps part of the tongue of the footwear. Further, an additional member may be provided on the tongue of the ankle support part 220 to be attached to the tongue of general footwear.

Further, the ankle support part 220 may be constructed to be larger than the size of the wearer's ankle so as to prevent foreign objects from entering the footwear. In other words, if the ankle support part 220 adapted to general footwear is larger than the wearer's ankle, the wearer's ankle can be completely covered by overlapping both sides of the ankle support part 220.

Meanwhile, the ankle support 200 of this invention may be constructed such that the ankle support 200 is closed without the opening 222. In this case, part of the ankle support part 220 may comprise an elastic member having elasticity, or the entire part of the ankle support part 220 may comprise an elastic member.

As such, the ankle support 200 of this invention is constructed so that the lower portion of the ankle support 200 is attached to the interior of the footwear, unlike the prior art, thus moving relative to the footwear within a predetermined range. Therefore, the footwear having the ankle support 200 of this invention moves together with the ankle support 200 without restricting the motion of the wearer's ankle joint in the footwear, thus ensuring the flexible movement of the ankle, therefore allowing unrestricted motion. Further, the footwear having the ankle support 200 of this invention is constructed so that the lower portion of the ankle support 200 is secured to the interior of the footwear. Thereby, even though large shocks are applied to the wearer's ankle due to intense activity, the wearer's ankle is protected by both the footwear and the ankle support 200, thus allowing the wearer's ankle to be efficiently protected.

The preferred embodiment of the ankle support according to this invention will be described below in detail.

As shown in FIGS. 2 to 4, the ankle support 200 of this invention is made of different kinds of materials. These parts are sewn to be combined with each other. The tightening unit includes eyelets and a shoelace. In a detailed description, the foot insertion hole 221 and the opening 222 are formed on the top and the front of the ankle support part 220, respectively. The ankle support part 220 includes the leg covering means and the support means. The leg covering means surrounds a leg portion above the ankle joint, and the support means prevents the wearer's foot from moving about the ankle joint beyond a predetermined range.

The leg covering means includes a strip 224 which is coupled to the upper end of the support means and surrounds the leg portion above the wearer's ankle joint.

Further, the support means includes an aerating part 223 and a reinforcing strip. The aerating part 223 is provided at a position around the heel section to allow air to flow in and out of the footwear. The reinforcing strip functions to partially reinforce the wearer's ankle. The aerating part 223 dissipates heat generated in the footwear, as a person moves or exercises with the footwear on, in addition to allowing exterior fresh air to circulate in the footwear. The aerating part 223 is made of a soft material permitting ventilation. It is preferable that the aerating part 223 extend upwards from a lower end to a predetermined height.

Further, the reinforcing strip comprises a first strip part 225, a second strip part 226, and a third strip part 227. The first strip part 225 is arranged along the wearer's Achilles' tendon to couple the strip 224 of the leg covering means to the attaching means 210. The second strip part 226 is located on the wearer's inside malleolus to couple the strip 224 to the attaching means 210. Further, the third strip part 227 is located on the wearer's outside malleolus to couple the strip 224 to the attaching means 210. In this case, the reinforcing strip may have at least one each first, second, third strip part 225, 226, 227. The reinforcing strip serves as tape to massage the muscular nerves so as to prevent the muscular nerves of the feet from being abruptly relaxed or contracted before a person exercises. Such a reinforcing strip is preferably made of the same hard material as footwear, such as leather.

When the strip 224 and the first, second, and third strip parts 225, 226, and 227 are developed, they form the shape of an "m". As such, the ankle support 220 surrounds and supports the wearer's ankle, and efficiently protects the ankle joint, joining the ankle to the foot, and various ligaments, including the Achilles' tendon, using the elements constituting the reinforcing strip.

Meanwhile, the ankle support part 220 has a plurality of folding parts 228 that is naturally folded when the wearer's ankle bends forwards, thus increasing the range of motion of the wearer's ankle. That is, the ankle support part 220 is constructed so that both sides thereof are uneven, thus forming a plurality of folding parts 228. Further, tightening parts 229 are provided on an upper end of the ankle support part 220 to protrude upwards, thus efficiently fastening the ankle support 200 to the wearer's ankle. The tightening parts 229 are connected to both ends of the strip 224. Further, a plurality of eyelets 230 is formed on the ankle support part 220, with a shoelace 325 passing through the eyelets 230 to connect both sides of the opening 222 to each other.

The footwear with the ankle support according to this invention will be described below with reference to soccer shoes, as an example of the footwear. However, this invention is not limited to soccer shoes, but is applicable to various footwear, such as athletic footwear for various sports including soccer, basketball, tennis, baseball, rugby football, badminton, skating, volleyball, etc., work footwear, safety footwear, mountain-climbing footwear, or military footwear. That is, when the ankle support of this invention is adapted to shoes not extending above the wearer's ankle, it is unnecessary to adjust the height of the shoe. Meanwhile, when the ankle support of this invention is adapted to boots extending higher than the wearer's ankle, the ankle support is inserted into the boot after lowering the height of the boot below the ankle.

Figure 5:
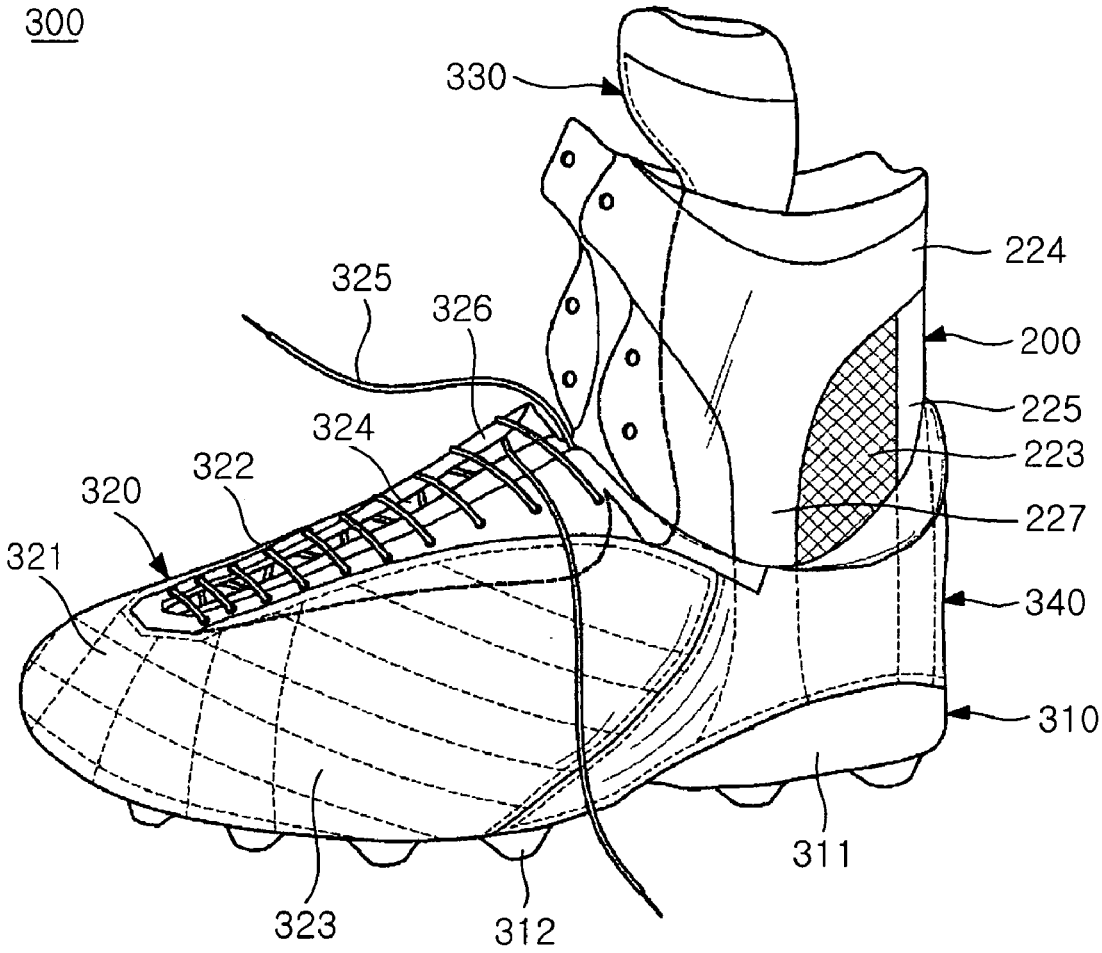
FIG. 5 is a perspective view showing a soccer shoe to which the ankle support of this invention is adapted, with part of the soccer shoe not yet laced up.
Figure 6:
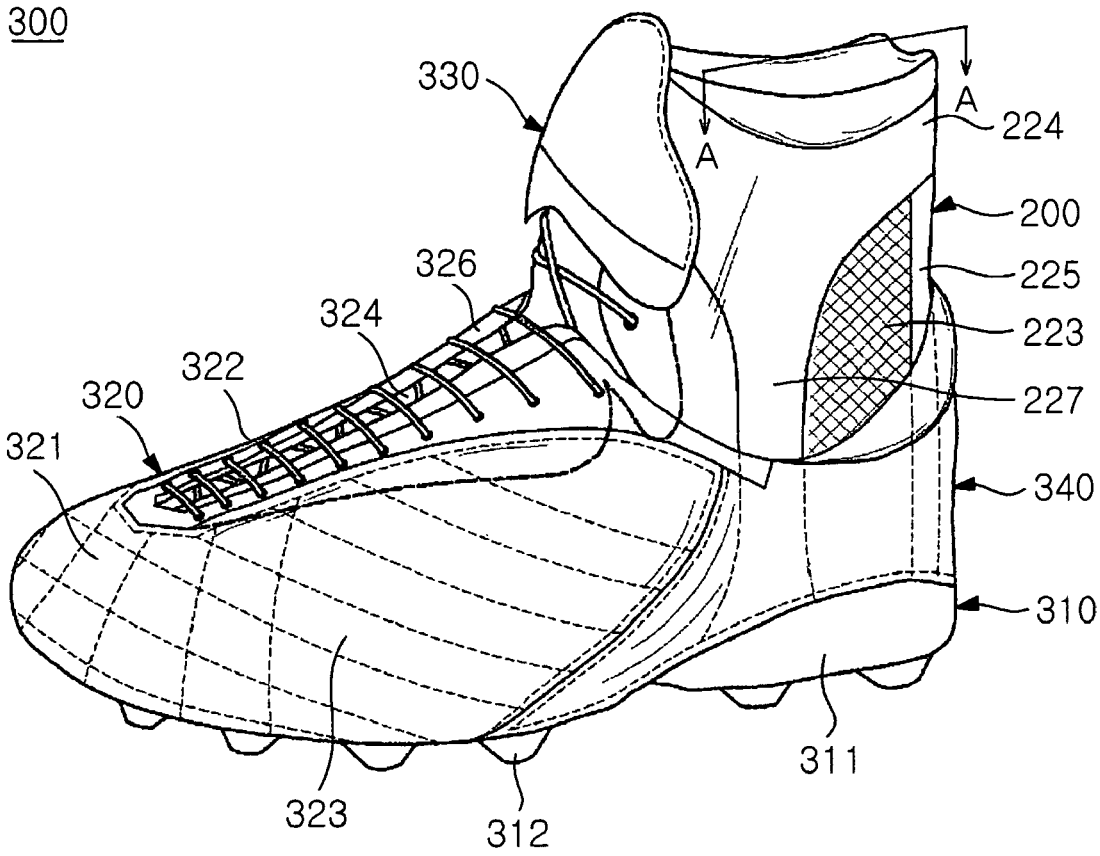
FIG. 6 is a perspective view showing the soccer shoe of FIG. 5, in which the soccer shoe is completely laced up.
Figure 7:
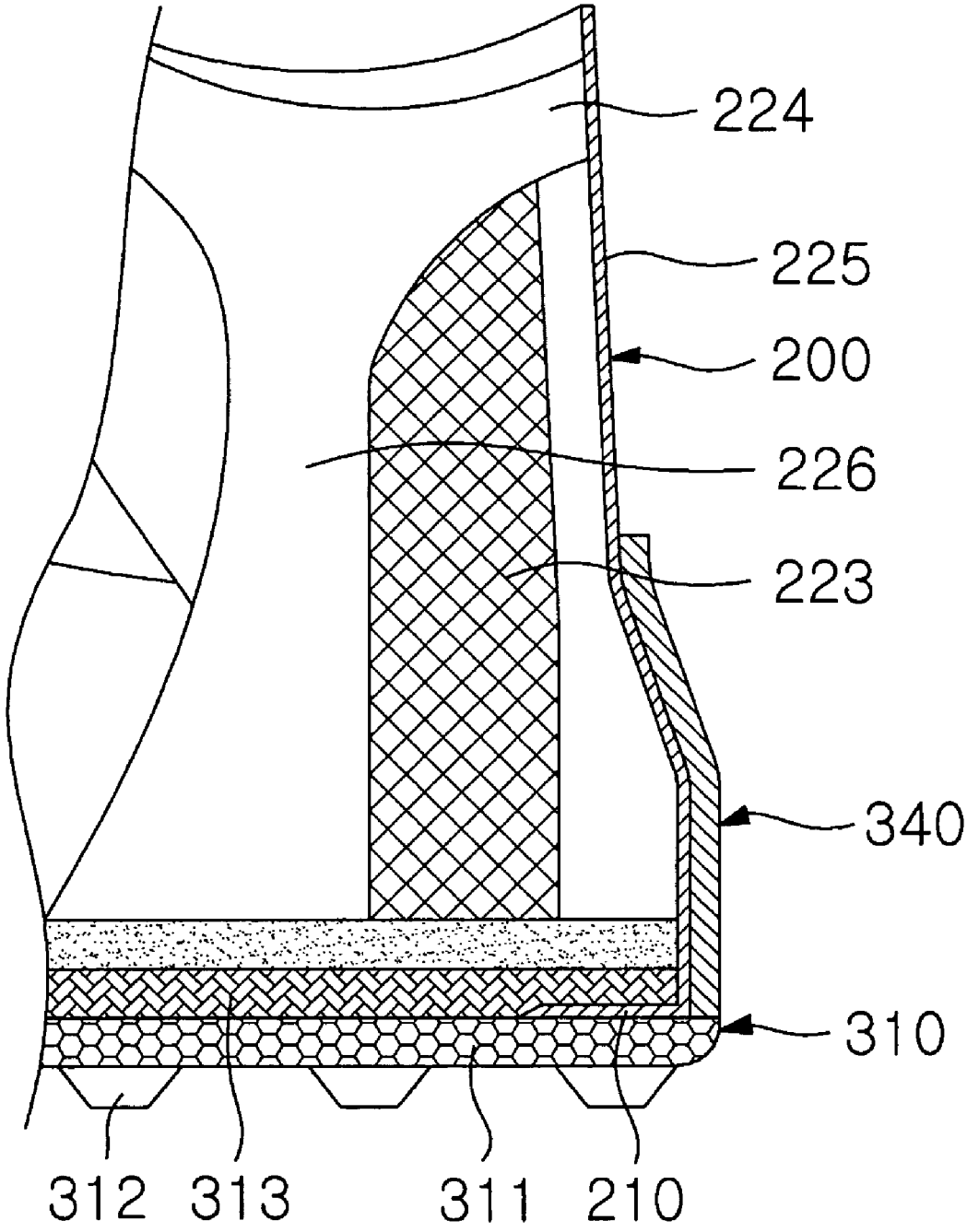
FIG. 7 is a sectional view taken along line A-A of FIG. 6, showing part of the soccer shoe.

FIG. 5 is a perspective view showing a soccer shoe to which the ankle support of this invention is adapted, with part of the soccer shoe not yet laced up, FIG. 6 is a perspective view showing the soccer shoe of FIG. 5, in which the soccer shoe is completely laced up, and FIG. 7 is a sectional view taken along line A-A of FIG. 6, showing part of the soccer shoe.

As shown in FIG. 5 to 7, the soccer shoe 300 includes a sole 310, an upper 320, and a heel section 340, with an ankle support being attached to the soccer shoe 300. The ankle support extends upwards from the heel section to surround part of the foot and part of the leg between which the ankle joint is positioned, while the lower portion of the ankle support is secured to the sole in the interior of the soccer shoe.

The sole 310 includes an outsole 311 on which a plurality of anti-slip studs 312 is formed. Further, a middle sole 313 is provided on the outsole 311 to be integrated with the outsole 311.

The upper 320 includes a toe top 321 to cover the wearer's toes, a first vamp 322 to cover the inside portion of the top side of the foot, a second vamp 323 to cover the outside portion of the top side of the foot, and a tongue 330. The tongue 330 is connected at an end thereof to the toe top 321 and covers the top side of the foot. Further, the upper 320 includes a vamp tightening unit which pulls side ends of the first and second vamps 322 and 323 so that the side end of the first vamp 322 approaches the side end of the second vamp 323. In this case, the vamp tightening unit includes a plurality of eyelets and a shoelace 325. The eyelets are formed on eyelet tabs 326 which are provided on the side ends of the first and second vamps 322 and 323. The shoelace 325 passes through the eyelets. However, the vamp tightening unit is not limited to the above-mentioned structure. The vamp tightening unit may be manufactured like the tightening unit of the ankle support.

The ankle support 200 is manufactured as described above. That is, the ankle support 200 is constructed such that the lower portion of the ankle support 200 is secured to the sole in the interior of the soccer shoe, and the ankle support 200 extends upwards along the heel section 340 to surround part of the foot and part of the leg between which the wearer's ankle joint is positioned.

The soccer shoe 300 of FIGS. 5 to 7 is provided with the ankle support 200 constructed as shown in FIGS. 2 to 4. However, the attaching means 210, provided on the lower portion of the ankle support 200, is attached between the outsole 311 and the midsole 313. That is, the ankle support 200 is constructed so that the leg covering means is cut at a position ranging from the top side of the foot to the shinbone. At the cut position, both ends of the leg covering means are pulled to approach each other using the tightening unit. The attaching means 210 of the ankle support 200 may be attached to the heel section 340, the first vamp 322, or the second vamp 323.

According to this invention, the first end of the cut leg covering means may be continuously connected to the side end of the first vamp 322, and the second end of the cut leg covering means may be continuously connected to the side end of the second vamp 323.

Figure 8:
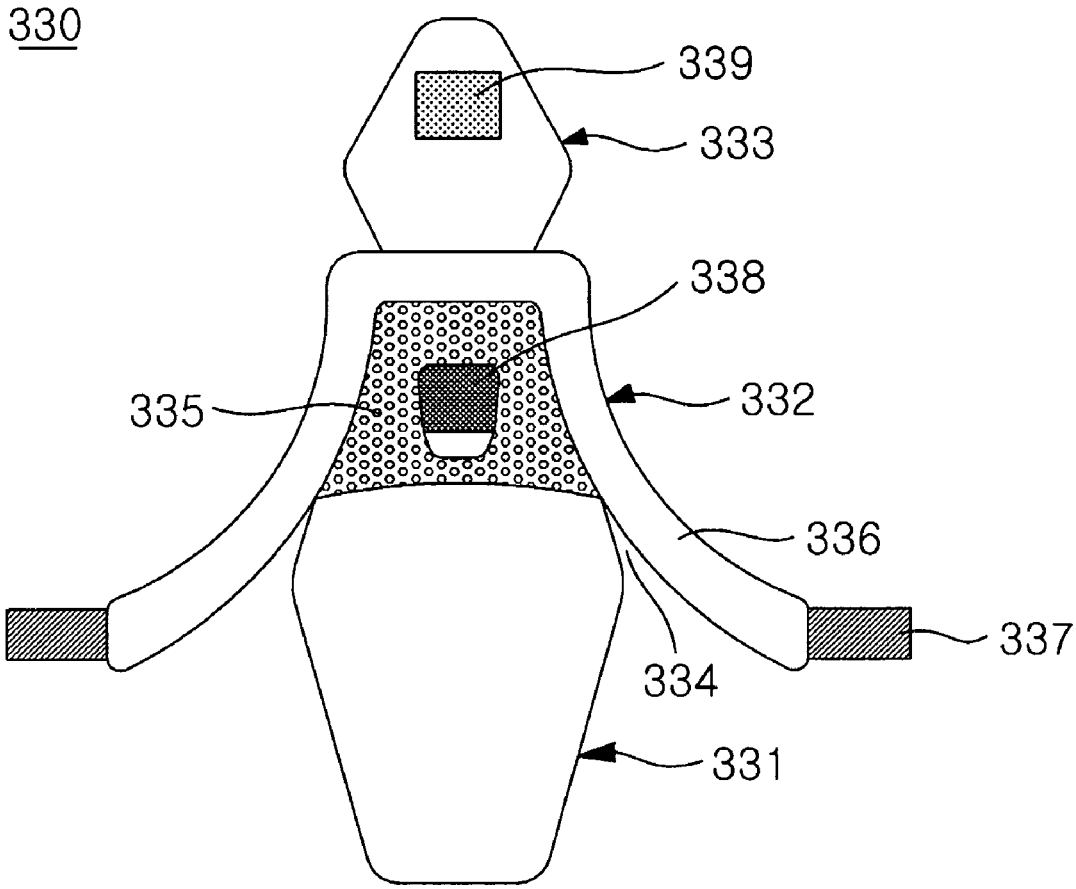
FIG. 8 is a plan view to show the tongue of the soccer shoe of FIG. 5.

FIG. 8 is a plan development figure showing a tongue of the soccer shoe of FIG. 5. As shown in FIG. 8, the tongue 330 serves to prevent foreign objects from entering the interior of the shoe. The tongue 330 is sewn at an end thereof to the inside surface of a slit 324, and covers the slit 324 and the opening 222 of the ankle support 200.

The tongue 330 includes a slit covering part 331, an opening covering part 332, and a lace locking part 333. The slit covering part 331 is sewn at an end thereof to the inside surface of the slit 324 to cover the slit 324. The opening covering part 332 is connected to the slit covering part 331 to cover the opening 222. The lace locking part 333 is folded at an end of the opening covering part 332 to be attached to the upper surface of the opening covering part 332, thus preventing the shoelace from undesirably becoming untied.

Preferably, the junction between the slit covering part 331 and the opening covering part 332 is located at the position where the wearer's ankle bends. More preferably, notches 334 are formed on both sides of the tongue 330 to allow the tongue 330 to be easily folded, in addition to ensuring flexible motion of the ankle. The notches 334 achieve the same effect as the folding parts 228 of the ankle support part 220.

The opening covering tongue 332 includes a heat dissipation part 335 and a pair of extension parts 336. The heat dissipation part 335 serves to dissipate heat from the interior of the shoe. The extension parts 336 protrude outwards from both sides of the heat dissipation part 335 to define the notches 334, and are attached to the sole so that the tongue 330 is located on the top side of the wearer's foot. Preferably, the heat dissipation part 335 extends upwards from the junction between the slit covering part 331 and the opening covering part 332, namely, from the position where the wearer's ankle bends. It is preferable that an elastic band 337 having elasticity be provided at a predetermined position on each extension part 336, thus allowing the tongue 330 to conveniently move. Further, it is more preferable that the extension parts 336 be attached to the sole in the shoe while being positioned between the inside of the shoe and the outside of the ankle support 200. Such a construction allows a person to conveniently wear the shoe. FIG. 8 shows the case where the elastic band 337 is provided on an end of each extension part 336.

The lace locking part 333 is folded at an upper end of the opening covering part 332, and is attached to the upper surface of the heat dissipation part 335 using a fastening unit, thus preventing the shoelace from becoming untied. The fastening unit comprises a first piece 338 of the Velcro fastener provided on the upper surface of the heat dissipation part 335, and a second piece 339 of the Velcro fastener provided on the lower surface of the lace locking part 333. In this case, only an end of the first piece 338 is attached to the upper surface of the opening covering part 332 so that the first piece 338 does not affect the shoelace 325, thus allowing the opening covering part 332 to bend freely. On the other hand, the second piece 339 is completely secured to the lace locking part 333.

The invention claimed is:

1. A shoe having a sole, an upper, and a heel section not extending above one's ankle joint, the shoe comprising:

an ankle support having an opening through which one's ankle can be inserted when worn, and supporting part of a foot and part of a leg between which the ankle joint is located, wherein a lower portion of the ankle support is secured to an interior of the shoe and wherein the ankle support comprises:

a leg covering means constructed such that at least part of the ankle support surrounds a leg portion above the wearer's ankle joint, and a support means extending to the leg covering means from the lower portion of the ankle support that is secured to the shoe, the support means preventing the wearer's foot from moving about the ankle joint beyond a predetermined range, and wherein the support means comprises:

a first reinforcing strip part arranged along a wearer's Achilles' tendon and extending from the lower portion that is secured to the shoe to a portion of the leg covering means above the ankle, a second reinforcing strip part located over a wearer's inside malleolus and extending to the leg covering means from the lower portion that is secured to the shoe, a third reinforcing strip part located over a wearer's outside malleolus and extending to the leg covering means from the lower portion that is secured to the shoe, and an aerating part made of a soft material permitting ventilation and provided between the first, second and third reinforcing strip parts to allow air to flow in and out of the shoe.

2. The shoe according to claim 1, wherein the leg covering means comprises a strip, the strip being coupled to an upper end of the support means to surround the leg portion above the wearer's ankle joint.

3. The shoe according to claim 1, wherein the upper comprises:

a toe top to cover wearer's toes;

a first vamp to cover an inside portion of a top side of the foot;

a second vamp to cover an outside portion of the top side of the foot; and a tongue coupled at an end thereof to the toe top, and covering the top side of the foot.

4. The shoe according to claim 3, wherein at least part of the ankle support is secured to the heel section, the first vamp, or the second vamp of the shoe.

5. The shoe according to claim 3, wherein the tongue comprises a heat dissipation part, the heat dissipation part extending upwards from a position where a wearer's ankle is bent, and dissipating heat from the interior of the shoe.

6. The shoe according to claim 5, wherein the tongue comprises a pair of extension parts, the extension parts extending outwards from both sides of the heat dissipation part and being secured to the interior of the shoe.

7. The shoe according to claim 6, wherein at least part of each of the extension parts comprises an elastic band having elasticity.

8. The shoe according to claim 6, wherein each of the extension parts is secured to the interior of the shoe while being positioned between an inside surface of the shoe and an outside surface of the ankle support.

9. The shoe according to claim 3, further comprising:

a vamp tightening unit to pull a side end of the first vamp and a side end of the second vamp, thus allowing the side ends of the first and second vamps to approach each other.

10. The shoe according to claim 9, wherein the leg covering means of the ankle support is cut at a position ranging from the top side of the foot to a shinbone, and a tightening unit is provided at the cut position to pull both ends of the leg covering means, thus causing the ends of the leg covering means to approach each other.

11. The shoe according to claim 10, wherein a first end of the cut leg covering means is continuously connected to the side end of the first vamp, and a second end of the cut leg covering means is continuously connected to the side end of the second vamp.

* * * * *